US010240432B2

(12) United States Patent
Reilly et al.

(10) Patent No.: US 10,240,432 B2
(45) Date of Patent: Mar. 26, 2019

(54) GROUT DELIVERY

(71) Applicant: Reflex Technology International Pty Ltd, Balcatta, Western Australia (AU)

(72) Inventors: James Barry Reilly, Bayswater (AU); Michael Gerasimoff, Tuart Hill (AU)

(73) Assignee: Reflex Technology International Pty Ltd., Balcotta, Wester Australia (AU)

( * ) Notice: Subject to any disclaimer, the term of this patent is extended or adjusted under 35 U.S.C. 154(b) by 0 days.

(21) Appl. No.: 15/312,456

(22) PCT Filed: May 19, 2015

(86) PCT No.: PCT/AU2015/000294
§ 371 (c)(1),
(2) Date: Nov. 18, 2016

(87) PCT Pub. No.: WO2015/176107
PCT Pub. Date: Nov. 26, 2015

(65) Prior Publication Data

US 2017/0089176 A1 Mar. 30, 2017

(30) Foreign Application Priority Data

May 19, 2014 (AU) ..... 2014901860

(51) Int. Cl.
*E21B 27/02* (2006.01)
*E21B 33/13* (2006.01)
(Continued)

(52) U.S. Cl.
CPC ..... *E21B 34/10* (2013.01); *E21B 27/02* (2013.01); *E21B 33/138* (2013.01); *E21B 33/14* (2013.01)

(58) Field of Classification Search
CPC ..... E21B 27/02; E21B 33/138; E21B 33/16; E21B 17/18; E21B 34/10
See application file for complete search history.

(56) References Cited

U.S. PATENT DOCUMENTS 4,859,119 A 8/1989 Chida et al.
5,064,098 A 11/1991 Hutter, III et al.
(Continued)

FOREIGN PATENT DOCUMENTS

AU 2012318278 A1 6/2013
WO 2010/096870 A1 9/2010
WO 2013/078514 A1 6/2013

OTHER PUBLICATIONS

International Search Report and Written Opinion of the International Searching Authority for corresponding International Patent Application No. PCT/AU2015/000294 dated Aug. 13, 2015, 16 pgs.

*Primary Examiner* — Zakiya W Bates
(74) *Attorney, Agent, or Firm* — Merchant & Gould P.C.

(57) ABSTRACT

A grout delivery system for delivery of a grout as a flowable substance comprising a mixture of two grout component materials at a downhole location. The grout delivery system comprises an elongate body comprises two reservoirs configured as cartridges for receiving respective charges of the two grout component materials. The two cartridges each comprise a piston. A selectively openable closure configured as a valve is provided adjacent the bottom end of each cylinder. Each piston is operably to progressively advance towards the valve, thereby expelling grout component material from the respective cartridge through the valve. When the grout delivery system is at the desired location downhole and a fluid seal established downhole, fluid such as water is pumped into the drill string and pressurized. Initially, fluid pressure is exerted on the two pistons indirectly via an actuator to initiate movement of the two pistons in concert. At a later stage, fluid under pressure is exerted directly on the pistons to continue their movement in concert. Retrieval of the grout delivery system may necessitate relief of the hydrostatic pressure differential across the fluid seal established downhole so that the grout delivery system can be
(Continued)

lifted relatively easily from the downhole drilling assembly. A selectively operable pressure relief system is provided for this purpose.

10 Claims, 11 Drawing Sheets

(51) Int. Cl.

| | |
|---|---|
| ***E21B 34/10*** | (2006.01) |
| ***E21B 33/138*** | (2006.01) |
| ***E21B 33/14*** | (2006.01) |

(56) References Cited

U.S. PATENT DOCUMENTS

| | | | | |
|---|---|---|---|---|
| 5,425,424 | A | 6/1995 | Reinhardt et al. | |
| 5,533,570 | A * | 7/1996 | Streich | E21B 27/02 166/153 |
| 5,582,251 | A | 12/1996 | Bailey et al. | |
| 2009/0038856 | A1* | 2/2009 | Vuyk, Jr. | E21B 7/18 175/65 |
| 2015/0226029 | A1* | 8/2015 | Oliver | B01F 5/0256 166/285 |

* cited by examiner

GROUT DELIVERY

This application is a National Stage Application of PCT/AU2015/000294, filed 19 May 2015, which claims benefit of Serial No. 2014901860, filed 19 May 2014 in Australia and which applications are incorporated herein by reference. To the extent appropriate, a claim of priority is made to each of the above disclosed applications.

TECHNICAL FIELD

This invention relates to a tool assembly. In particular, the invention concerns a downhole tool assembly operable when in a downhole condition by selective generation of fluid pressure in the borehole above the tool assembly.

The invention has been devised particularly, although not necessarily solely, as a downhole tool assembly configured as a grout delivery system for delivery of grout to a downhole location within a borehole.

The invention also relates to certain components of such a tool assembly, including for example a cartridge for a flowable substance.

Further, the invention relates to a method of delivery of a flowable substance.

BACKGROUND ART

The following discussion of the background art is intended to facilitate an understanding of the present invention only. The discussion is not an acknowledgement or admission that any of the material referred to is or was part of the common general knowledge as at the priority date of the application.

As mentioned above, the invention is particularly applicable to a delivery system for delivery of grout to a downhole location within a borehole. Accordingly, the invention will primarily be discussed in relation to that application.

In borehole drilling operations, drilling fluid (commonly referred to as drilling mud) is used for cleaning and cooling a drill bit of a downhole drilling system during the drilling process and for conveying drilling cuttings to the ground surface.

In certain circumstances, an underground area through the borehole is being drilled can be unstable or otherwise vulnerable to the development of fractures through which drilling fluid can escape. The loss of drilling fluid is undesirable, both in economic terms and also as it can lead to a reduction in fluid pressure within the borehole.

With a view to preventing or at least inhibiting the loss of drilling fluid, it is known to deliver grout to the vulnerable location within the borehole in order to seal fractures through which fluid may otherwise escape.

A known grout delivery system is disclosed in WO 2013/078514, the contents of which are incorporated herein by way of reference. With this grout delivery system, grout is formed as a settable mixture of first and second flowable grout material components. The grout delivery system is adapted to be conveyed to a location within the borehole to which the grout is to be delivered in a grouting operation, and to be subsequently retrieved after the grouting operation.

The grout delivery system comprises a delivery head, a first reservoir for receiving a charge of the first grout material component and a second reservoir for receiving a charge of the second grout material component. The delivery system is operable to cause supplies of the first and second grout material components to be conveyed to a mixing zone at the delivery head where they are mixed to form the grout and delivered into the borehole. The first and second reservoirs are configured as chambers of variable volume, whereby volume contract of the chambers causes the first and second grout material components to be expelled therefrom and conveyed to the delivery head. Specifically, each variable volume chamber is defined by a piston and cylinder arrangement, with a piston being selectively moveable within the cylinder to effect volume variation of the chamber. The pistons are responsive to fluid pressure generated within the borehole above the tool assembly, the arrangement being that the fluid pressure acts on the pistons to cause the pistons to move along their respective cylinders, thereby causing volume contraction of the chambers.

The fluid pressure is selectively generated by pumping fluid (typically water) into the drill string above the downhole tool assembly. With this arrangement, water under pressure flows into the tool assembly and acts upon the pistons to cause the pistons to move along their respective cylinders, thereby causing volume contraction of the chambers. This expels grout component material from the reservoirs and causes the expelled material to ultimately flow into the mixing zone, at which the grout component materials mix to react chemically to form the grout. The resulting grout is discharged as a viscous fluid mixture through the outlet and delivered into the borehole. At the completion of the grout delivery process, the delivery of pressurized fluid into the borehole is terminated and the grout delivery system is retrieved by raising it to the ground surface using an overshot assembly attached to a wire line.

In the arrangement disclosed in WO 2013/078514, the chambers are accommodated permanently within the downhole tool assembly and are required to be periodically replenished with grout component material.

In order to facilitate ease of replenishment, it would be desirable for the grout component materials to be contained within a container such a cartridge which can be replaced as necessary when replenishment grout component material is required.

An aspect of the present invention is directed to such an arrangement.

With the arrangement disclosed in WO 2013/078514, it is important that the pistons travel along their respective cylinders in concert (unison) so that appropriate relative proportions of grout component materials are delivered into the mixing zone. If, for any reason, one piston were to advance at a rate different from the other piston, there is a likelihood that the required relative proportions of the grout component materials may be outside of acceptable limits, potentially leading to problems with the resultant grout.

Any tendency for the pistons to advance at different rates would most likely occur at the initial stage of the operation when each piston is required to commence its movement along the respective cylinder. It is at this stage that any tendency for the pistons to resist movement in response to the fluid pressure would be most pronounced. This is the time at which the pistons are most vulnerable to "stick" in the cylinders, thereby disrupting movement of the pistons in concert. Once the pistons have commenced movement along the cylinders there is little likelihood of any "sticking" to disrupt their movement in concert.

Accordingly, it would be advantageous there to be an arrangement in which the two pistons are caused to commence movement in concert in response to fluid pressure at the start of the grouting operation. Once the pistons have commenced to move in concert, there is far less likelihood that either piston would later move in a way in which is not in concert with the other.

A further aspect of the present invention seeks to provide such an arrangement.

With the arrangement disclosed in WO 2013/078514, the downhole tool assembly locates on a landing ring on a downhole drilling assembly already within the borehole. This location establishes a fluid seal whereby fluid (water) can be pumped into the borehole above the downhole tool assembly to generate the fluid pressure as previously described in order to operate the grouting system.

It has been found that this can establish a fluid pressure differential across the fluid seal which at least partially remains even after pumping of fluid (water) under pressure into the borehole has ceased, with the result that the fluid pressure differential can act to resist separation between the downhole tool assembly and the downhole drilling assembly and thereby present difficulties in retrieving the downhole tool assembly.

An aspect of the present invention seeks to address such a difficulty.

It is against this background and the problems and difficulties associated therewith that the present invention has been developed.

SUMMARY OF INVENTION

According to a first aspect of the invention there is provided a apparatus for containing a flowable substance, the apparatus comprising a body defining a cylinder having a first end and a second end, a piston receivable in the cylinder for sliding movement therealong, a closure receivable in the cylinder for location at or adjacent the second end, a reservoir within the cylinder defined between the piston and the closure, the closure being selectively openable in response to pressure exerted by a flowable substance in the reservoir in response to movement of the piston along the cylinder causing volume contraction of the reservoir.

Typically, the apparatus comprises a cartridge for reception a tool assembly operable to dispense the flowable substance. The apparatus will hereinafter be referred to as a cartridge for ease of reference but it should be understood that the two terms can be used interchangeably where appropriate.

The cylinder may be of any appropriate cross-sectional shape. Typically, the cylinder is circular in cross-section but need not necessarily be so and other cross-section shapes are envisaged, including for example rectangular and oval cross-section shapes.

Preferably, the closure comprises a valve.

The valve may comprise a valve body received in the second end of the cylinder.

Preferably, the valve configured to allow substance contained in the reservoir to be dispensed therefrom in response to a prescribed pressure being exerted by the substance on the valve.

With this arrangement, the valve can inhibit leakage of substance from the reservoir while the cartridge is in storage and also while in piston is not being actuated to move along the cylinder.

Preferably, the piston is removable to allow a charge of flowable substance to be introduced into the cartridge. This is advantageous as it may permit the cartridge to be replenished with flowable substance.

The flowable substance may comprise a grout material, or a component of grout material for mixing with another component of grout material to form a grout mixture. Typically, the grout material comprises a settable grout material.

The valve may be configured to inhibit fluid flow in the reverse direction. In this regard, the valve may inhibit flow of water in the reverse direction; for example, flow of water from a borehole into the cartridge. In certain circumstances, it is important that there be no water ingress into the reservoir. It can be particularly important that there be no water ingress in circumstances where the reservoir contains a water-activated grout component material.

The valve may comprise a valve element and a baffle upstream of the valve element, the baffle being positioned to confront an oncoming flow of the substance, thereby causing the flow to be diverted around the baffle before acting upon the valve element. This buffers the valve element from the direct affect of the oncoming stream of the flowing substance.

According to a second aspect of the invention there is provided a tool assembly for receiving an apparatus according to the first aspect of the invention, the tool assembly being operable to cause movement of the piston along the cylinder.

Preferably, the tool assembly is configured to receive two cartridges according to the first aspect of the invention. The tool assembly may be configured to receive more than two cartridges according to the first aspect of the invention.

The two or more cartridges may comprise separate units or the cartridges may be integrated into a common unit.

Preferably, the piston is operable in response to fluid pressure. Where there are two or more cartridges, each piston is preferably operable in response to fluid pressure.

Typically, the fluid pressure is generated by delivery of fluid (such as water) into a drill string in a borehole, the arrangement being that the tool assembly is configured to be accommodated within the drill string and exposed to fluid within the drill string.

Preferably, the tool assembly comprises a control valve means for controlling the supply of fluid pressure to cause movement of the piston(s) along the respective cylinder(s), the control valve means being configure to allow admission of fluid under pressure in response to a fluid pressure supply exceeding a prescribed level.

Where the tool assembly is configured to receive two or more cartridges, the tool assembly may further comprise an actuator, whereby fluid pressure can act initially upon the actuator to initiate movement of the pistons in concert (unison) and subsequently bypass the actuator to act directly upon the pistons to continue their movement in concert along the cylinders.

This arrangement is advantageous as the actuator serves to initiate movement of the pistons in concert, counteracting any tendency of any one or more of the pistons to "stick" in the cylinders, thereby disrupting movement of the pistons in concert. Once the pistons have commenced movement along the cylinders there is little likelihood of any "sticking" to disrupt their movement in concert, and so fluid pressure can be utilised to act directly upon the pistons to continue their movement in concert along the cylinders.

The actuator may be configured to act mechanically upon the pistons to cause them to move in concert.

The tool assembly may be configured to permit fluid to bypass the actuator once the latter has acted upon the pistons to cause them to move in concert whereby the bypassing fluid thereafter acts upon the pistons to continue their movement in concert along the cylinders. In this regard, the tool assembly may comprises means to permit fluid to bypass the actuator once the latter has acted upon the pistons to cause them to move in concert whereby the bypassing fluid thereafter acts upon the pistons to continue their movement in concert along the cylinders.

The tool assembly may further comprise a flow path initially configured to direct fluid flow in a manner in which fluid pressure acts initially upon the actuator to initiate movement of the two pistons in concert and subsequently to cause the fluid flow to bypass the actuator to act directly upon the pistons to continue their movement in concert along the cylinders.

The actuator may be configured as a piston arrangement comprising a piston head and a plurality of piston rods one corresponding to each cartridge, the piston rods extending from the piston head to one side thereof.

The piston head may be accommodated within a cylinder section bounded by a cylinder wall for slidable and sealing engagement with the cylinder wall. With this arrangement, the piston head divides the cylinder section into first and second chambers which vary in volume as the piston head moves within the cylinder section. Further, the piston head may include an opening through which a shank portion extends, with the piston head being in slidable and sealing engagement with the shank portion. The shank portion may accommodate a flow passage extending between one or more inlet ports opening onto the cylinder section and one or more outlet ports, whereby the flow passage within the shank portion, together with the inlet port(s) and the outlet port(s), define part of the fluid flow path. With this arrangement, fluid within the first chamber is isolated from the inlet port(s) in one condition as determined by the position of the piston head, and fluid within the first chamber can enter the flow passage within the shank portion through inlet port(s) and discharge from that flow passage through outlet port(s) in another condition as determined by the position of the piston head. Specifically, the piston head functions to initially isolate the inlet port(s) from the first chamber, thereby ensuring that fluid pressure acts directly upon the piston head. As the piston arrangement advances along the shank portion, the inlet port(s) ultimately communicate with the first chamber whereupon fluid can flow from the first chamber through the flow passage within the shank portion to the outlet port(s) to discharge therefrom and act directly upon the pistons within the cartridges.

The piston rods extending from the piston head are preferably configured for detachable engagement with the cartridge pistons. In one arrangement, each cartridge piston may comprise a piston body having a side wall in sliding and sealing engagement with the respective cylinder, and opposed end faces, with the end face confronting the actuator incorporating a recess into which the free end of the respective piston rod can be removably received. With this arrangement, the actuator is operable under fluid pressure to initiate movement of the cartridge pistons in concert along the cylinders in response to fluid pressure at the start of a delivery operation. Once the pistons have commenced movement they are then subjected to direct fluid pressure to continue their movement in concert along the cylinders, initially separating from the piston rods and then independently continuing their movement along the cylinders.

The supply fluid pressure to actuate the tool assembly may comprise pressurised water. Once the water pressure exceeds the prescribed level (which in an embodiment is about 215 psi), the pressure-responsive control valve is caused to open and thereby allow water flow along the fluid path and into the first chamber.

The invention according to the second aspect of the invention is particularly suitable for delivery of a flowable substance in the form of grout into a borehole during the drilling process to seal any fractures through which drilling fluid may escape from the borehole. Typically, when unstable or other ground which would be vulnerable to leakage of drilling fluid is encountered, the drilling process is temporarily halted and the delivery system according to the invention is introduced into the borehole to deliver grout for sealing the unstable ground area. Prior to introduction of the delivery system, the drilling head is withdrawn partially to expose the vulnerable area of ground to which the grout is to be delivered. After the grout has been delivered and has set, the drilling procedure is recommenced and the grouted section of ground is drilled.

With such an arrangement, the tool assembly may be conveyed to the location within the borehole at which the grout is to be delivered in any suitable manner. A particularly convenient arrangement for conveying the tool assembly to the delivery location within the borehole, and also subsequently retrieving the delivery system, is by way of a wire line system of the type well known in borehole drilling practices.

The tool assembly may further comprise a portion adapted to engage a downhole arrangement to establish the fluid seal, and a pressure relief system having a pressure relief fluid flow path extending between ports on opposed sides of the seal, the pressure relief fluid flow path having a closed condition to block fluid flow between the ports and an open condition for fluid flow between the ports to facilitate pressure relief across the seal. The tool assembly may have any one or more of the further features discussed below in relation to a seventh aspect of the invention.

According to a third aspect of the invention there is provided a delivery system for delivery of a flowable substance as a mixture comprising first and second components at a location to which the delivery system is conveyed, the delivery system comprising a first reservoir for receiving a charge of the first component, a second reservoir for receiving a charge of the second component, each reservoir being defined within a respective body defining a cylinder having a first end and a second end, a piston receivable in the cylinder for sliding movement therealong, a closure receivable in the cylinder for location at or adjacent the second end, whereby the reservoir is defined within the cylinder between the piston and the closure, the closure being selectively openable in response to pressure exerted by the respective component of the flowable substance in the reservoir in response to movement of the piston along the cylinder causing volume contraction of the reservoir, each piston being operable for movement along the respective cylinder in response to fluid pressure, and an actuator, whereby fluid pressure can act initially upon the actuator to initiate movement of the pistons in concert and subsequently bypass the actuator to act directly upon the pistons to continue their movement in concert along the cylinders.

The bodies defining the first and second reservoirs may be configured as cartridges. For this purpose, the delivery system may further comprise a housing in which the cartridges are removably receivable.

With this arrangement, the flowable substance comprises a fluid mixture of the first and second components. The mixture is fluid in the sense that it can flow for delivery to the intended location. Typically, the flowable substance is intended to harden or set once at the delivery location.

Preferably, the delivery system further comprises a control valve means for controlling the supply of fluid pressure to cause movement of the pistons along the cylinders, the control valve means being configure to allow admission of fluid under pressure in response to a fluid pressure supply exceeding a prescribed level.

Typically, the fluid pressure supply is generated by delivery of fluid into a drill string in the borehole, the arrangement being that the delivery system is configured to be accommodated within the drill string and exposed to fluid within the drill string.

The invention according to the third aspect of the invention is particularly suitable for delivery of a flowable substance in the form of grout into a borehole during the drilling process to seal any fractures through which drilling fluid may escape from the borehole.

The grout constitutes a settable mixture of first and second flowable components which are brought together at the time of delivery. Accordingly, it is possible to employ grouts that otherwise might not be possible to use for sealing a borehole (particularly a borehole which contains water), including latex grout and urethane grout. The arrangement is particularly suitable for grouts which are activated upon mixing of components thereof together. The invention is particularly suitable for delivery of water-activated grout, as the grout can be isolated from water within the borehole until such time as it is delivered whereupon it can be activated upon contact with the water.

Typically, the first and second components of the flowable mixture comprise different material which are mixed together and interact to provide the flowable mixture. However, in certain applications, the first and second components of the flowable mixture may comprise the same material, in which case the first and second reservoirs each hold the same type of material.

According to a fourth aspect of the invention there is provided a method of delivery of a flowable substance as a flowable mixture comprising first and second components, the method comprising use of a delivery system according to the third aspect of the invention.

According to a fifth aspect of the invention there is provided a method of delivery of a flowable substance as a flowable mixture comprising first and second components from a first location to a second location spaced from the first location, the method comprising conveying a charge of the first component in a first reservoir and a charge of the second component in a second reservoir to the second location, discharging quantities of the first and second components from the reservoirs by actuating pistons to cause volume contraction of the reservoirs, mixing the discharged quantities of the first and second components to form the flowable mixture, and discharging the flowable mixture at the second location, wherein the pistons are operable for movement in concert in response to fluid pressure, whereby fluid pressure is directed to act initially upon an actuator to initiate movement of the pistons in concert and subsequently to bypass the actuator and act directly upon the pistons to continue their movement in concert.

Preferably, the method further comprises supplying the first component in a first cartridge and supplying the second component in a second cartridge. The first and second cartridges may comprise separate units or the cartridges may be integrated into a common unit.

According to a sixth aspect of the invention there is provided a method of delivery of delivery of grout as a settable flowable mixture comprising first and second components into a borehole, the method comprising conveying a charge of the first component in a first reservoir and a charge of the second component in a second reservoir into the borehole, discharging quantities of the first and second components from the reservoirs by actuating pistons to cause volume contraction of the reservoirs, mixing the discharged quantities of the first and second components to form the flowable mixture, and discharging the flowable mixture into the borehole, wherein the pistons are operable for movement in concert in response to fluid pressure, whereby fluid pressure is directed to act initially upon an actuator to initiate movement of the pistons in concert and subsequently to bypass the actuator and act directly upon the pistons to continue their movement in concert.

According to a seventh aspect of the invention there is provided a downhole tool assembly adapted to locate on a downhole arrangement to establish a fluid seal whereby fluid above the downhole tool assembly can be pressurised, the downhole tool assembly comprising a portion adapted to engage the downhole arrangement to establish the fluid seal therebetween, and a pressure relief system having a pressure relief fluid flow path extending between ports on opposed sides of the seal, the pressure relief fluid flow path having a closed condition to block fluid flow between the ports and an open condition for fluid flow between the ports to facilitate pressure relief across the seal.

The pressure relief across the seal facilitates breaking of the seal to in turn facilitate lifting of the downhole tool assembly from the downhole arrangement.

The portion of the downhole tool assembly adapted to engage the downhole arrangement to establish the fluid seal may comprise a landing collar. With this arrangement, the landing collar may be configured for location on a landing ring on the downhole arrangement to establish the fluid seal.

The ports may comprise one or more inlet ports on one side of said portion (being the upper side thereof) and one or more outlet ports on another side of said portion (being the lower side thereof).

The pressure relief system may further comprise a valve for selectively opening and closing the pressure relief fluid flow path with respect to fluid flow between the inlet and outlet ports.

Preferably, the valve for selectively opening and closing the pressure relief fluid flow path is operable remotely by an operator above ground.

The valve may comprise a valve stem and a valve seat, the valve stem being movable between open and closed conditions with respect to the valve seat. A flow gallery may be provided adjacent the valve seat and the valve stem may be movable into and out of the flow gallery. The valve stem may incorporate an axial flow passageway constituting part of the pressure relief fluid flow path between the inlet and outlet ports. The axial flow passageway may have an inlet end section for communication with the inlet port(s) and an outlet end section for communication with the outlet port(s). The axial flow passageway may open onto the free end of the valve stem at a valve outlet opening for communication with a flow gallery adjacent the valve seat when the valve stem is in the open condition. The outlet ports may open onto the flow gallery. The valve seat may includes a valve seat face and the free end of the valve stem may includes a valve sealing face which surrounds the valve outlet opening and which is configured for sealing engagement with the valve seat face. The valve stem may be movable axially between the closed condition in which the valve sealing face is in sealing engagement with the valve seat face to thereby close the valve outlet opening and the open condition in which the valve sealing face is clear of the valve seat face so allowing fluid to flow along the axial flow passageway into the flow gallery adjacent the valve seat and then to the outlet port(s) which open onto the flow gallery. In the closed condition, the portion of the valve stem within the flow gallery also blocks communication between the flow gallery and the outlet port(s). The valve stem normally occupies the closed condition, thereby blocking the pressure relief fluid flow path.

The valve stem may be operatively coupled to a mechanism operable remotely by an operator above ground. Specifically, the mechanism may normally occupy a first condition and be movable from that first condition to a second condition upon application of an uplifting force to a wire line attached to an overshot assembly coupled to the downhole tool assembly. The valve stem may be operably connected to the mechanism whereby movement of the latter from the first condition to the second condition causes axial movement of the valve stem from the normally closed condition to the open condition, thereby opening the pressure relief fluid flow path to allow fluid flow passed the fluid seal to provide hydrostatic pressure relief.

The downhole tool assembly according to the seventh aspect of the invention may further comprise a delivery system according to the third aspect of the invention.

BRIEF DESCRIPTION OF THE DRAWINGS

Further features of the present invention are more fully described in the following description of a non-limiting embodiment thereof. This description is included solely for the purposes of exemplifying the present invention. It should not be understood as a restriction on the broad summary, disclosure or description of the invention as set out above. The description will be made with reference to the accompanying drawings in which.

In the drawings, like structures are referred to by like numerals throughout the various views. The drawings shown are not necessarily to scale, with emphasis instead generally being placed upon illustrating the principles of the present invention.

Figure 1:
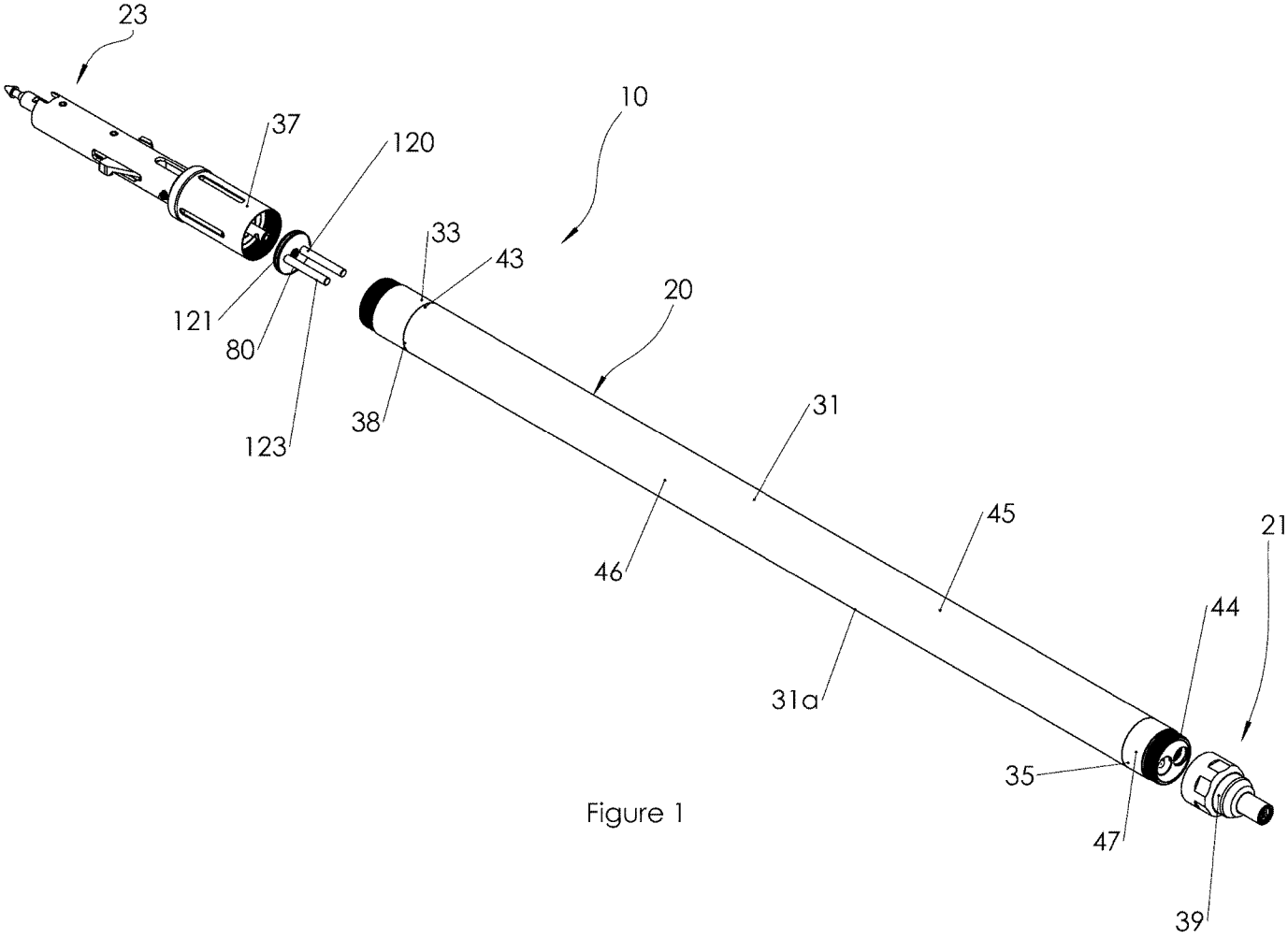
FIG. 1 is a partly exploded schematic perspective view of an embodiment of a downhole tool assembly according to the invention, the embodiment being configured as a grout delivery system.
Figure 2:
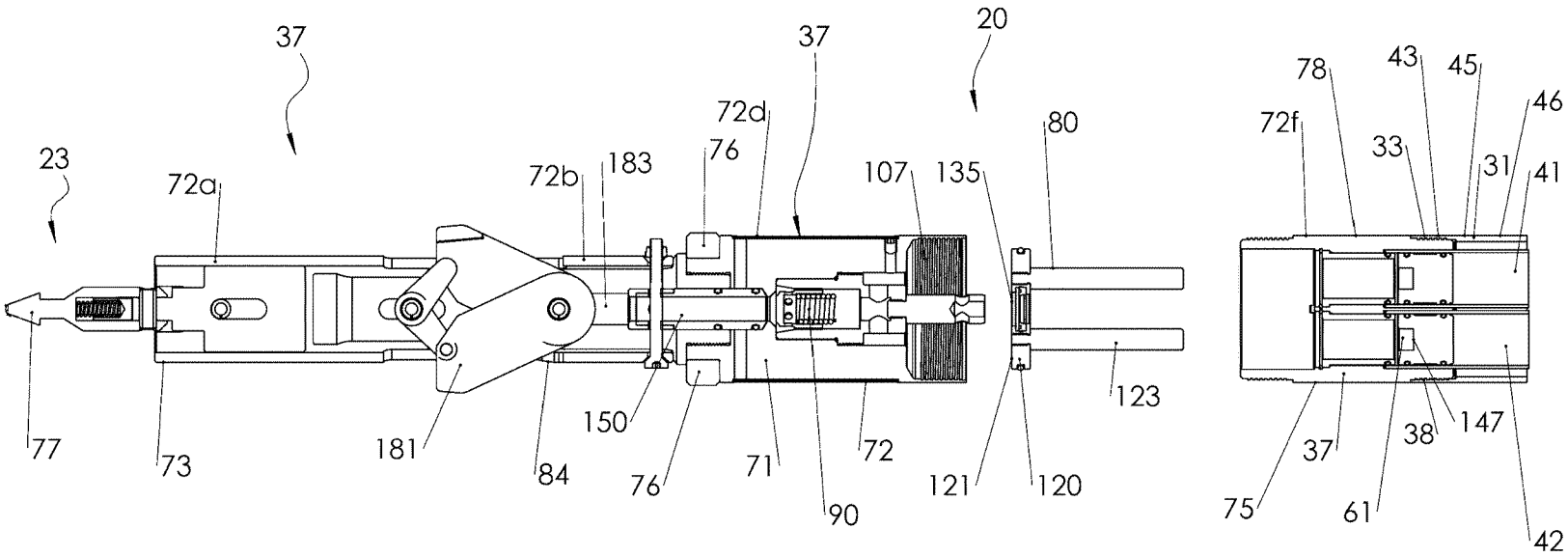
FIG. 2 is a fragmented schematic sectional view of an upper section of the grout delivery system shown in an exploded condition.
Figure 3:
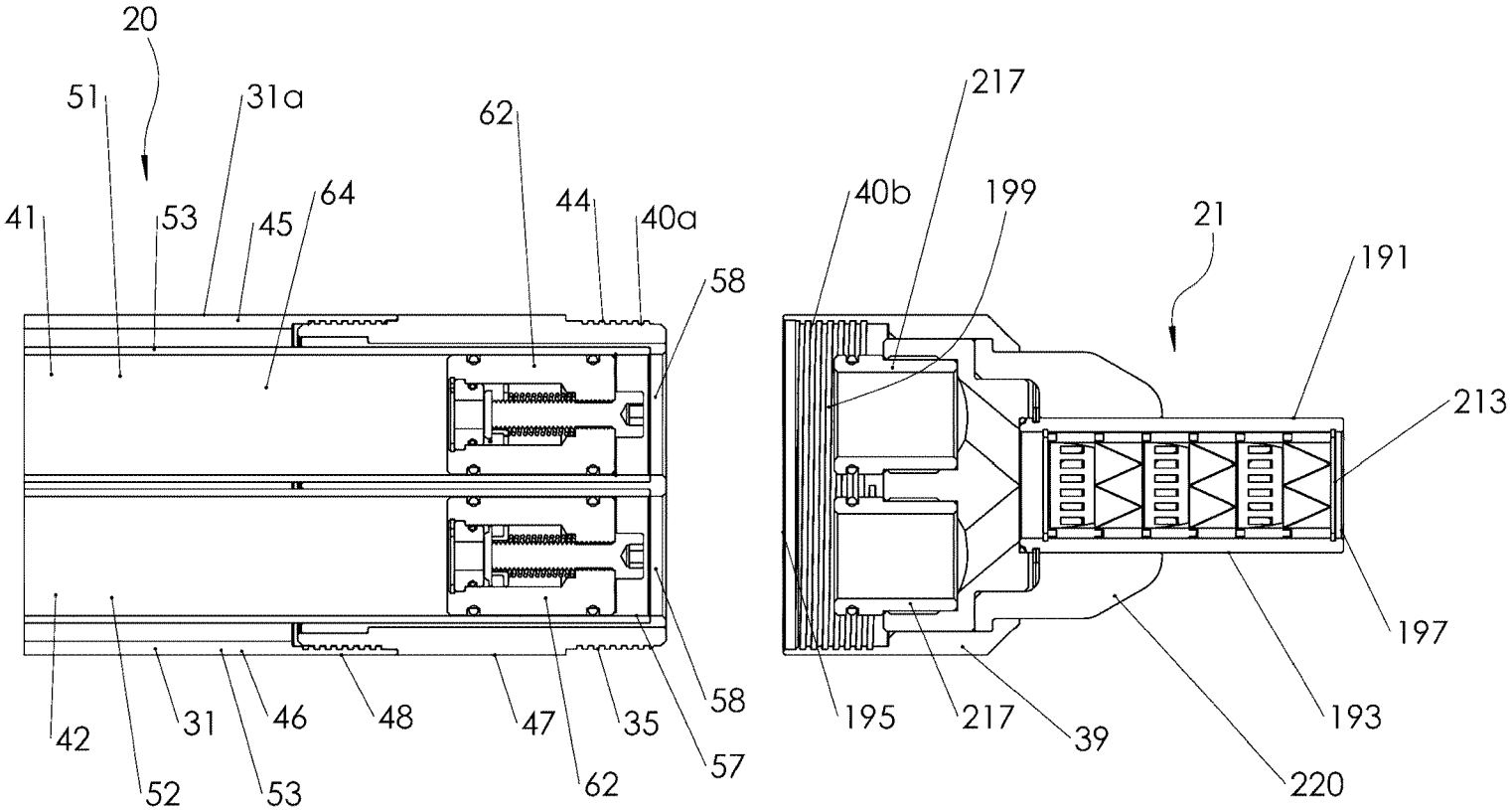
FIG. 3 is a fragmentary schematic sectional view of a lower section of the grout delivery system shown in an exploded condition.

The figures depict an embodiment of the invention. The embodiment illustrates certain configurations; however, it is to be appreciated that the invention can take the form of many configurations, as would be obvious to a person skilled in the art, while still embodying the present invention. These configurations are to be considered within the scope of the invention.

DESCRIPTION OF EMBODIMENTS

Referring to the drawings, there is shown an embodiment of a delivery system for delivery of a flowable substance as a mixture comprising first and second components at a location to which the delivery system is conveyed.

Specifically, the delivery system comprises a downhole tool assembly providing a grout delivery system 10 for use in a core drilling operation in a borehole survey operation. The core drilling operation is performed with a core drill (not shown) fitted as a bottom end assembly to a series of drill rods which together constitute a drill string 11 (shown only in FIG. 11). The core drill comprises an inner tube assembly, which includes a core tube, for core retrieval. The core drill also comprises an outer tube assembly. The drilling operation is typically performed using a drill rig, as would be well understood by a person skilled in the art. The drill rig typically has provision to circulate drilling fluid (drilling mud) through and around the bottom end assembly for cooling and removing cuttings during the core drilling operation. This includes a fluid circulating pump operable to circulate the drilling fluid. The fluid circulating pump may also be selectively operable to deliver other fluid, such as for example water, downhole under pressure.

The inner tube assembly further comprises a backend assembly which configured for engagement with an overshot assembly attached to a wire line, as is well-known in core drilling practices. With this arrangement, the inner tube assembly can be lowered into, and retrieved from, the outer tube assembly and the drill string in which the outer tube assembly is incorporated.

If, during the drilling operation, an underground area is encountered which is unstable or otherwise vulnerable to development of fractures through which drilling fluid can escape, there may be a need to stabilise that area with grout in order to seal fractures against the escape of drilling fluid. The grout delivery system 10 is provided for that purpose. In operation, the grout delivery system 10 is adapted to be conveyed to the location within the borehole to which the grout is to be delivered, and to be subsequently retrieved, by deployment of the overshot assembly attached to the wire line as used with the inner tube assembly.

In this embodiment, the grout delivery system 10 is adapted to deliver the grout as a flowable substance which can set after delivery. The flowable substance comprising a mixture of two grout component materials which chemically react when mixed together to facilitate setting of the grout. The two grout component materials are mixed together at the location of delivery within the borehole and then delivered as a highly viscous fluid mixture which constitutes the grout.

The grout delivery system 10 comprises an elongate assembly 20 having a bottom end 21 and a top end 23. The elongate assembly 20 is configured for deployment as a unit inside the drill string 11, with the top end 23 being adapted for engagement with the overshot assembly (not shown) so that the assembly 20 can be lowered down the drill string and hauled up the drill string using a wire line of known kind.

The elongate assembly 20 comprises an elongate body 31 having opposed ends 33, 35. A back end assembly 37 is releasably connected to end 33 of the elongate body 31 by way of threaded connection 38. A delivery head assembly 39 is connected to end 35 of the elongate body 31 by way of threaded connection 40.

The back end assembly 37 defines the top end 23 of the elongate assembly 20 and the delivery head assembly 39 defines the bottom end 21 of the elongate assembly 20.

The elongate body 31 comprises two reservoirs 41, 42 for receiving respective charges of the two grout component materials.

More particularly, the elongate body 31 comprises an upper end section 43, a lower end section 44, and an intermediate section 45 between the two end sections 43, 44. The elongate body 31 is of two-part construction and is configured as a cylindrical housing 31*a* having the two opposed end sections 43, 44. More particularly, the elongate body 31 comprises two parts, being a main body part 46 and extension part 47 adapted to be releasably connected together by way of threaded connection 48 therebetween. The threaded connection 48 comprises a female threaded connection on the main body part 46 and a male threaded connection extension part 47.

Upper end section 43 is integral with the main body part 46 and lower end section 44 is integral with the extension part 47.

The upper end section 43 includes a female threaded section 38*a* for threaded engagement with a mating male threaded section 38*b* on the back end assembly 37 to provide the threaded connection 38.

The lower end section 44 includes a male threaded section 40*a* for threaded engagement with a mating female threaded section 40*b* on the delivery head assembly 39 to provide the threaded connection 40.

The elongate body 31 is adapted to removably receive two cartridges 51, 52 configured to provide the two reservoirs 41, 42. In this way, the two cartridges 51, 52 receive respective charges of the two grout component materials.

More particularly, the two cartridges 51, 52 are received in the cylindrical housing 31*a* defined by the elongate body 31 in side-by-side relation between the ends sections 43, 44.

With this arrangement, the charges of the two grout component materials are isolated from each other within the cartridges 51, 52, and the cartridges can be readily replaced when replenishment grout component materials are required, as will be explained later.

The two cartridges 51, 52 each comprise a cylinder 53 having opposed ends which for ease of reference will be referred to as a top end 55 and a bottom end 57. A piston 61 is slidably and sealingly received in each cylinder 53. Further, a selectively openable closure configured as a valve 62 is provided adjacent the bottom end 57 of each cylinder 53.

Each piston 61 is initially located adjacent the top end 55 of the respective cylinder 53 and is operably to progressively advance towards the valve 62 adjacent the bottom end 57, as will be explained in more detail later. Grout component material is accommodated in the space 64 within the cylinder 53 between the piston 61 and the valve 62. Each space 64 constitutes a respective one of the two reservoirs 41, 42.

When initially located adjacent the top end 55 of the respective cylinder 53, each piston 61 is set inwardly from the top end 55 of the respective cylinder 53 to define a top socket formation 56 at that end, the purpose of which will be explained later.

Similarly, each valve 62 is set inwardly from the bottom end 57 of the respective cylinder 53 to define a bottom socket formation 58 at that end, the purpose of which will be explained later.

Figure 6:
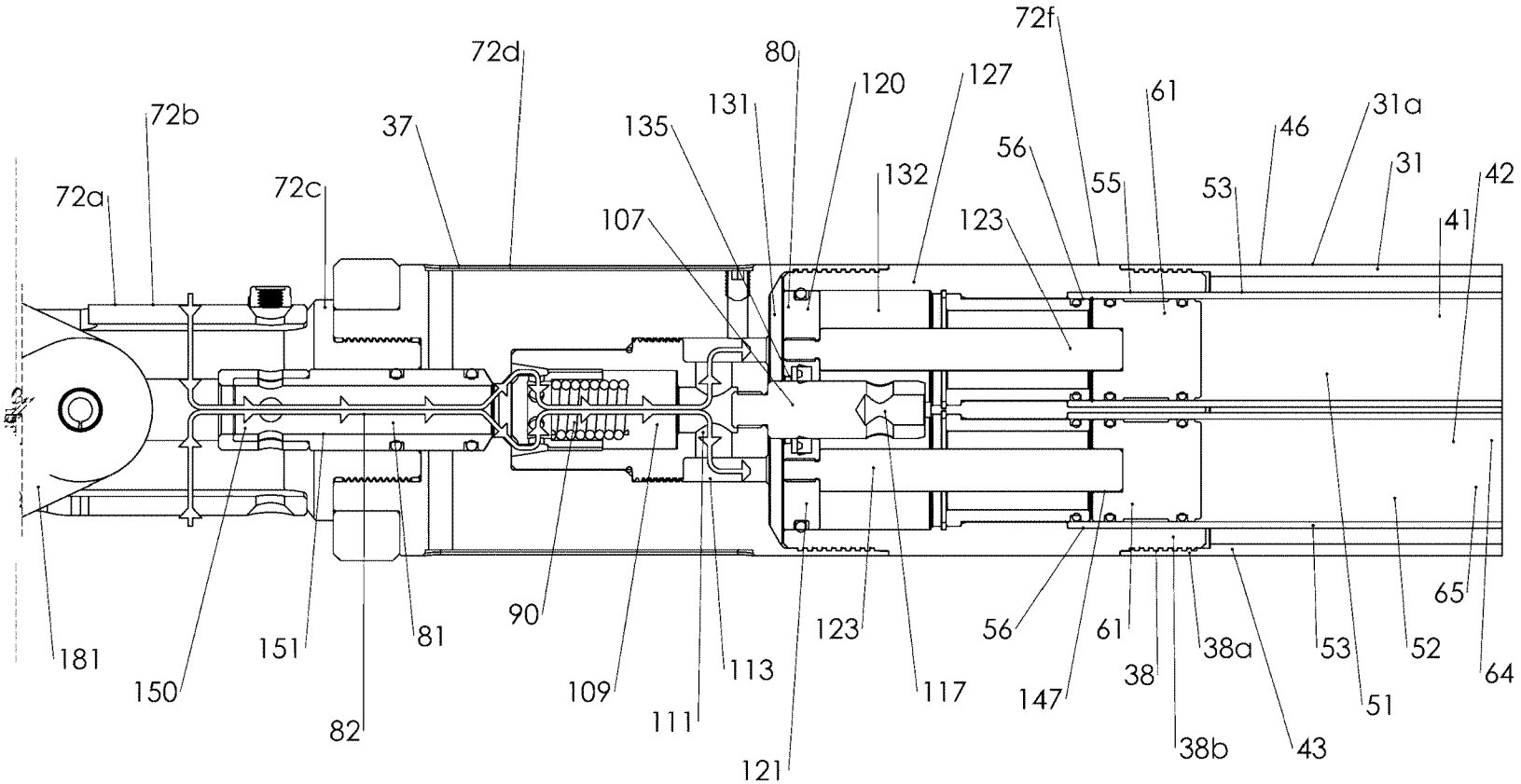
FIG. 6 is a fragmentary schematic side view illustrating an actuating system for two pistons forming part of the embodiment, and a fluid flow path within the system, the arrangement being shown at a stage at which the two pistons are about to commencement in concert.
Figure 7:
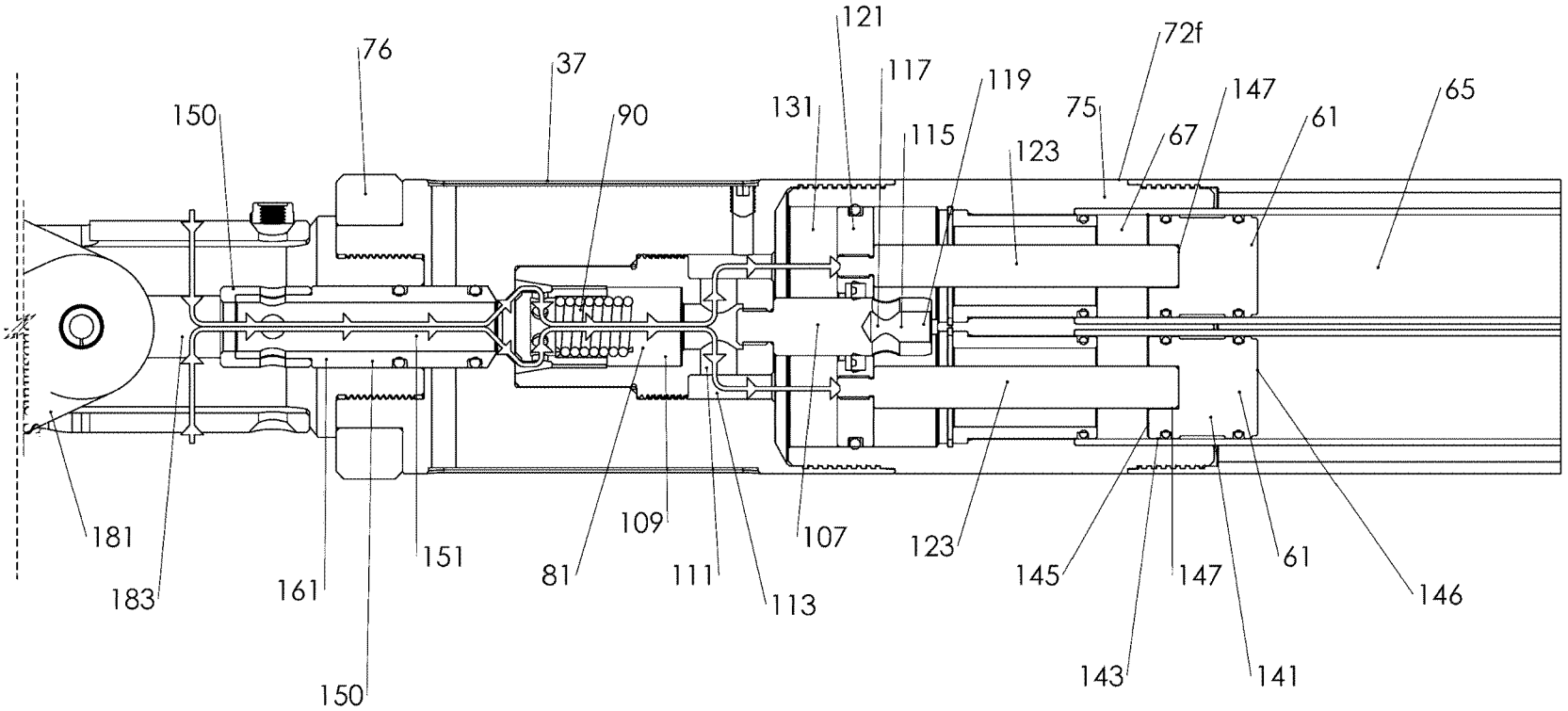
FIG. 7 is a view similar to FIG. 6, with the exception that the arrangement is shown at a later stage of movement of the two pistons.
Figure 8:
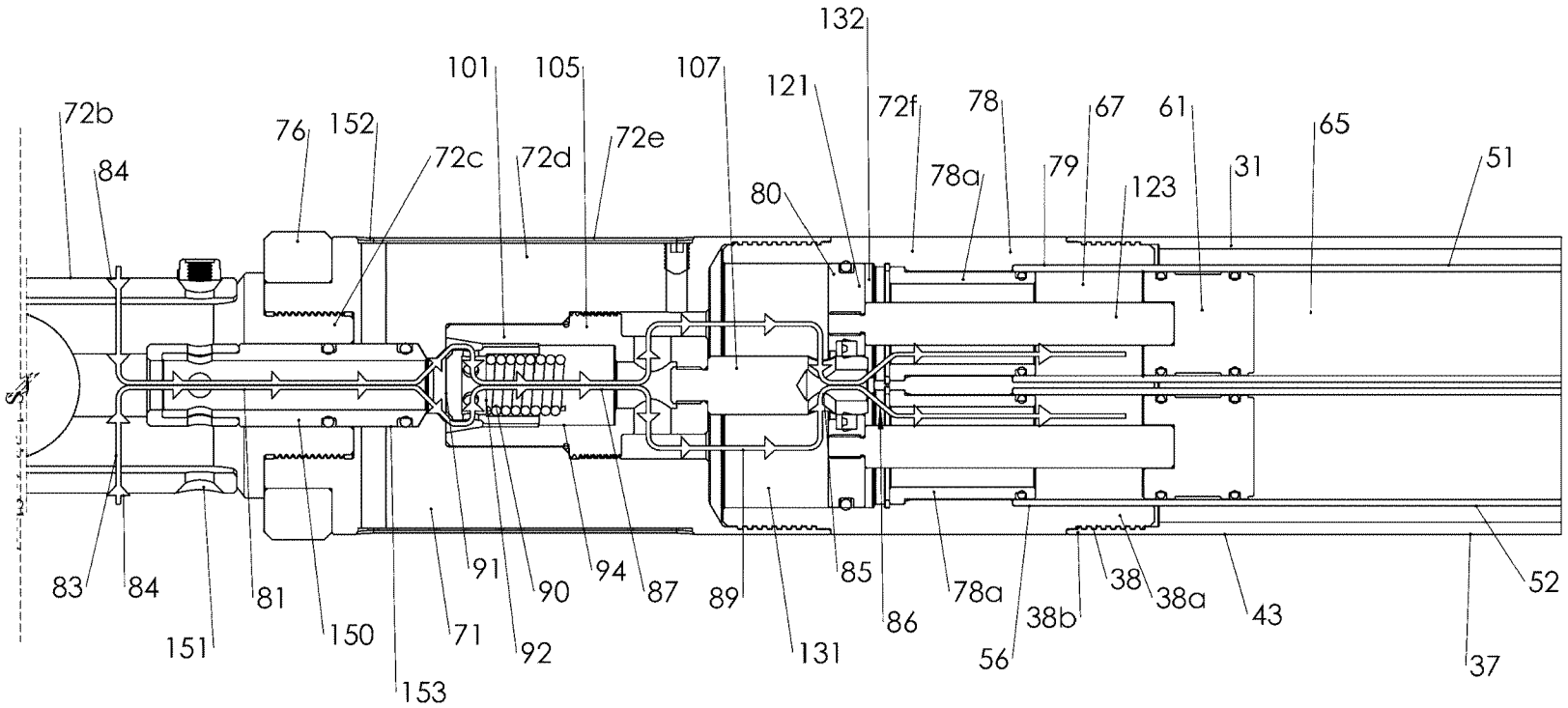
FIG. 8 is a view similar to FIG. 7, with the exception that the arrangement is shown at a later stage of movement of the two pistons.
Figure 9:
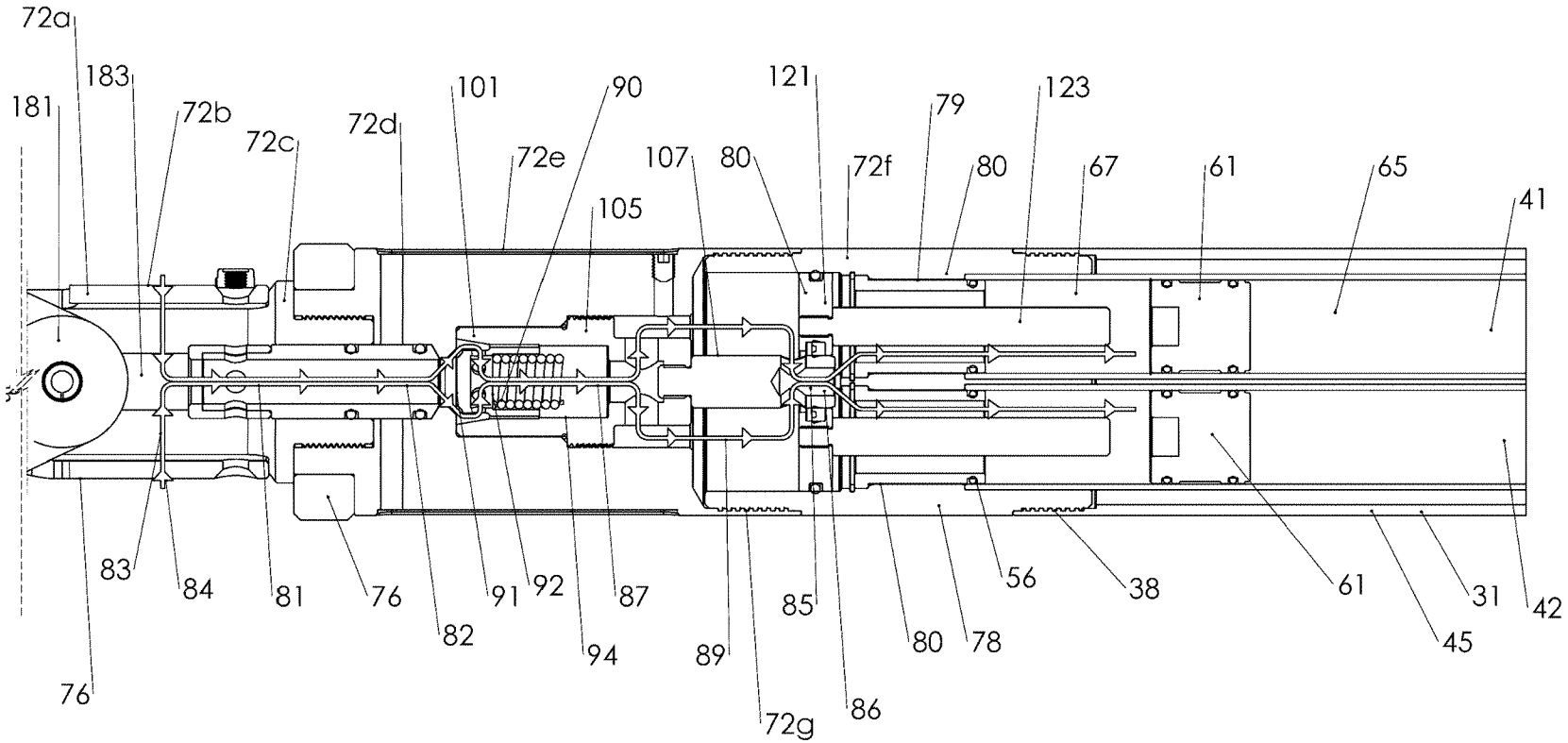
FIG. 9 is a view similar to FIG. 8, with the exception that the arrangement is shown at a later stage of movement of the two pistons.

Each piston 61 and respective cylinder 53 cooperate to define two opposed chambers 65, 67 within the confines of the cylinder which vary in volume with movement of the piston within the cylinder. The chamber 65 will hereinafter be referred to as the bottom chamber and the chamber 67 will hereinafter be referred to as the top chamber. In FIG. 6, the pistons 61 are depicted adjacent the top ends 55 of the cylinders 53. In FIGS. 7, 8 and 9, the pistons 61 are depicted progressively further along the cylinders so as to form the bottom chambers 65 and top chambers 67 on opposed sides of the pistons. As the pistons 61 advance progressively along the cylinders 53 as shown in FIGS. 7, 8 and 9, the volume of the top chambers 67 progressively increases and of the volume of the bottom chambers 65 progressively decreases. The volume of the space 64 within each cylinder 53 between the piston 61 and the valve 62 decreases commensurate with the decrease in volume of the bottom chamber 65. In fact, the space 64 provides the bottom chamber 65.

The two bottom chambers 65 communicate with the delivery head assembly 39 through the valves 62.

The two top chambers 67 communicate with the back end assembly 37. As will be explained in more detail later, the back end assembly 37 is adapted to selectively admit fluid under pressure into the two top chambers 67 to exert fluid pressure onto the pistons 61 and thereby drive the pistons along their respective cylinders 53, causing volume contraction of the two bottom chambers 65. The volume contraction of each bottom chamber 65 serves to expel at least part of the charge of the grout component material contained within the zone 64 through the valve 62 and into the delivery head assembly 39.

Each valve 62 comprises a valve body 63 configured for insertion into the respective cylinder 53 through the bottom end 57 thereof. In this embodiment, the valve body 63 is a friction fit in the cylinder 53. The valve body 63 defines a flow path 64 having an inlet port 64*a* and an outlet port 64*b* along which grout component material can flow from the respective bottom chamber 65 to the delivery head assembly 39, as will be described in more detail later.

The valve 62 is configured to allow flow of grout component material along the flow path 64 from the inlet port 64*a* to the outlet port 64*b*, but only in response to pressure equal to or exceeding a prescribed pressure being exerted by the grout component material within the bottom chamber 65. The prescribed pressure is that pressure at which the valve 62 is caused to open under the influence of pressure acting upon the valve. The prescribed pressure is 10 psi in this embodiment. It will, of course, be understood that the prescribed pressure can be selected at any appropriate level and need not be limited to 10 psi.

Figure 10:
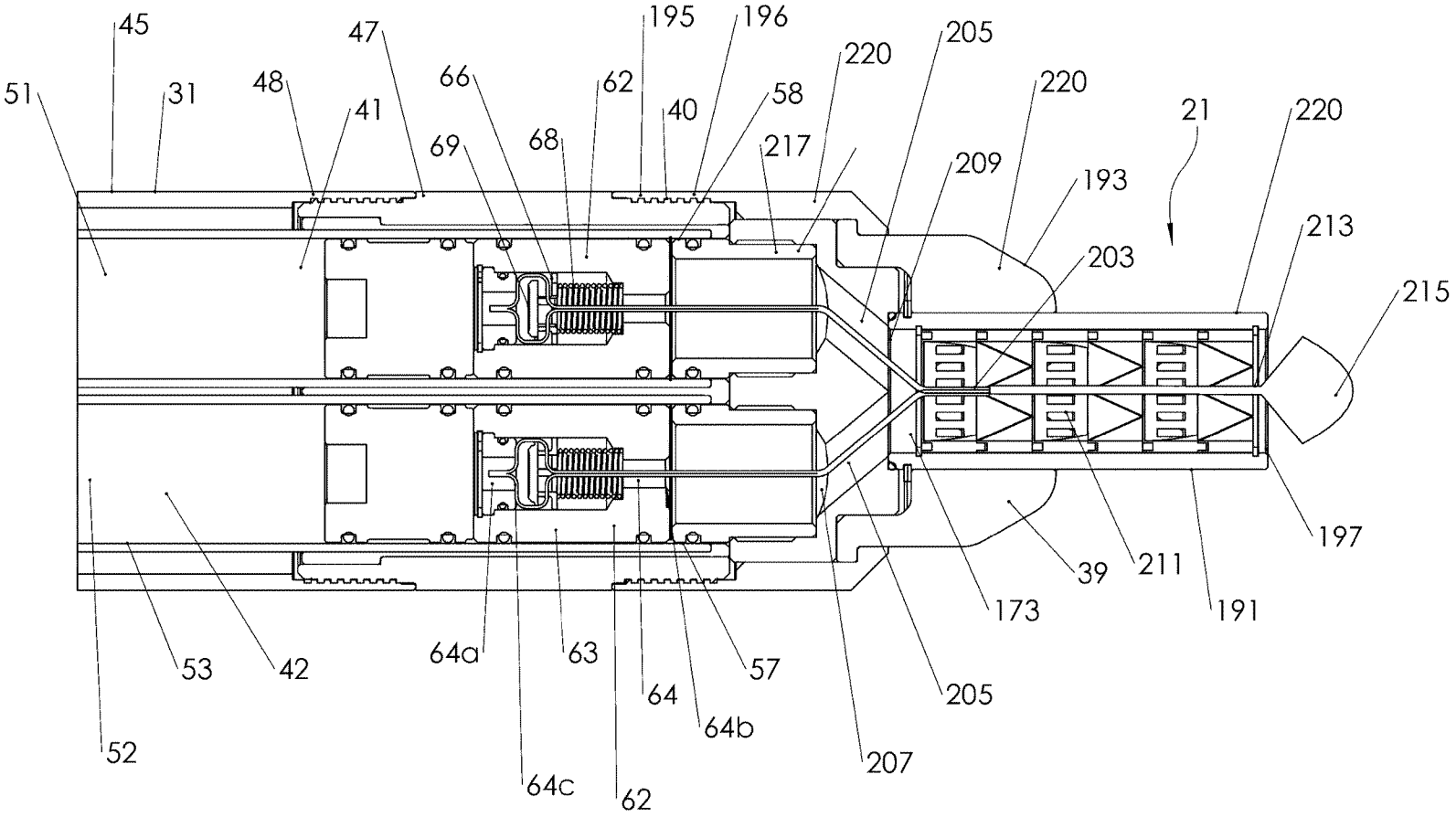
FIG. 10 is a fragmentary schematic sectional view of the lower section of the grout delivery system, illustrating in particular flow of grout component materials into a mixing zone.

Material flow along fluid flow path 64 is depicted by flow lines identified by reference numeral 64*c* in FIG. 10.

In this way, the valves 62 can inhibit leakage of grout component material from the spaces 64 while the cartridges 51, 52 are in storage, and also while in the elongate body 31 at times when the grout delivery system 10 is not being actuated to deliver grout.

Further, the valves 62 may inhibit fluid flow in the reverse direction. In this regard, the valves 62 can inhibit flow of water in the reverse direction from the borehole into the cartridges 51, 52. By way of explanation, in certain circumstances it is important that there be no water ingress into the two reservoirs 41, 42 while the grout delivery system 10 is immersed in the water. It can be particularly important that there be no water ingress in circumstances where the reservoirs 41, 42 contain a water-activated grout component material. In the absence of the valves 62, the grout delivery system 10 could possibly be vulnerable to ingress of water into the reservoirs 41, 42, particularly during descent of the grout delivery system 10 in water within the borehole owing to the forces likely to be exerted on it during the descent.

Each valve 62 comprises a valve seat 66 within a chamber 63*c* forming part flow path 64, and a valve member 68 movable into and out of sealing engagement with the valve seat 66. The valve member 68 is configured as a spring-loaded valve disc. With this arrangement, the spring-loaded valve discs 68 are effectively one-way valves, allowing grout component materials to be dispensed from the cartridges 51, 52 in the manner described previously, but inhibiting leakage and also inhibiting flow of water in the reverse direction from the borehole into the cartridges. In this embodiment, the two spring-loaded disc valves 68 are set to open in response to attainment of the prescribed pressure exerted by the grout component materials in the respective cartridges 51, 52.

Each valve 62 further comprises a baffle 69 upstream of the spring-loaded valve disc 68. The baffle is positioned to confront an oncoming flow of grout component material, causing the flow to be diverted around the baffle before acting upon the spring-loaded valve disc 68, as can be seen in FIG. 10. This buffers the spring-loaded valve disc 68 from the direct affect of the oncoming stream 64*c* of grout component material.

Figure 4:
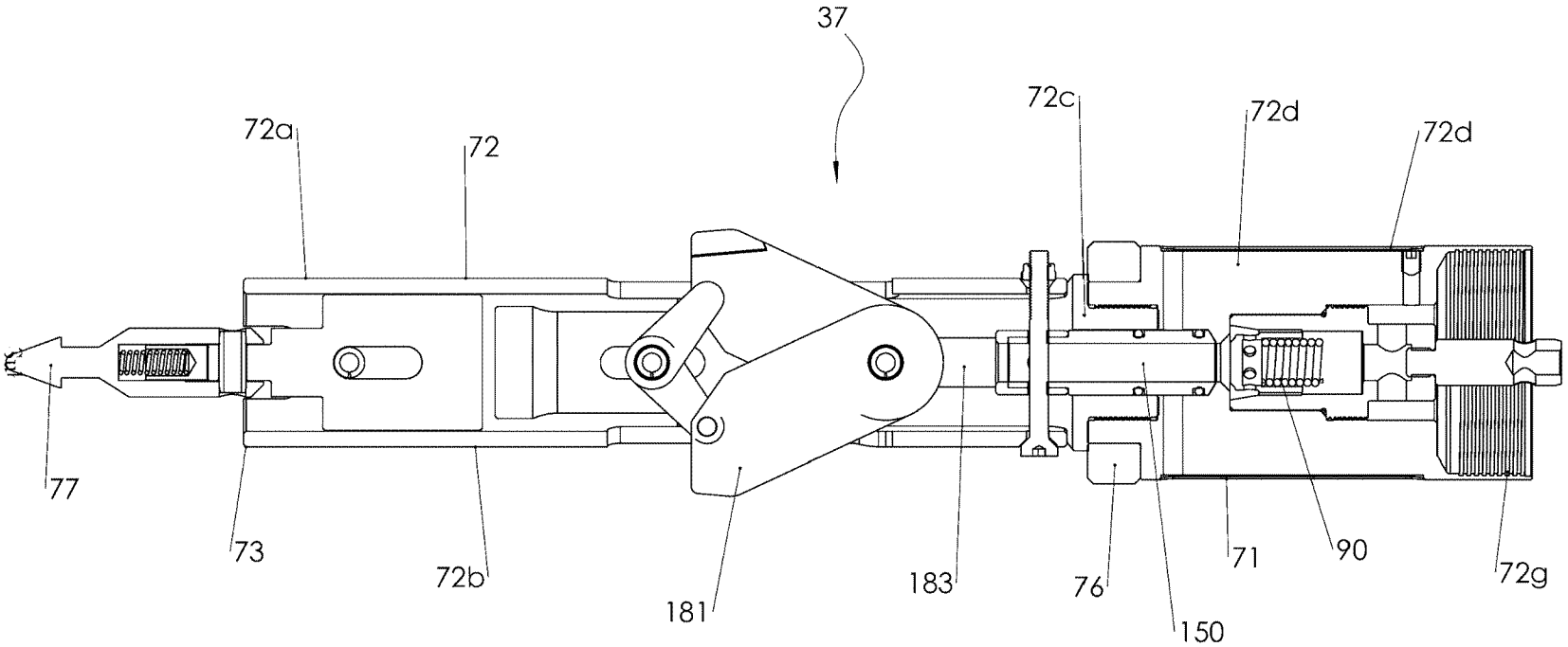
FIG. 4 is a schematic sectional side view of a back end assembly forming part of the grout delivery system, with the back end assembly being shown in one condition.
Figure 5:
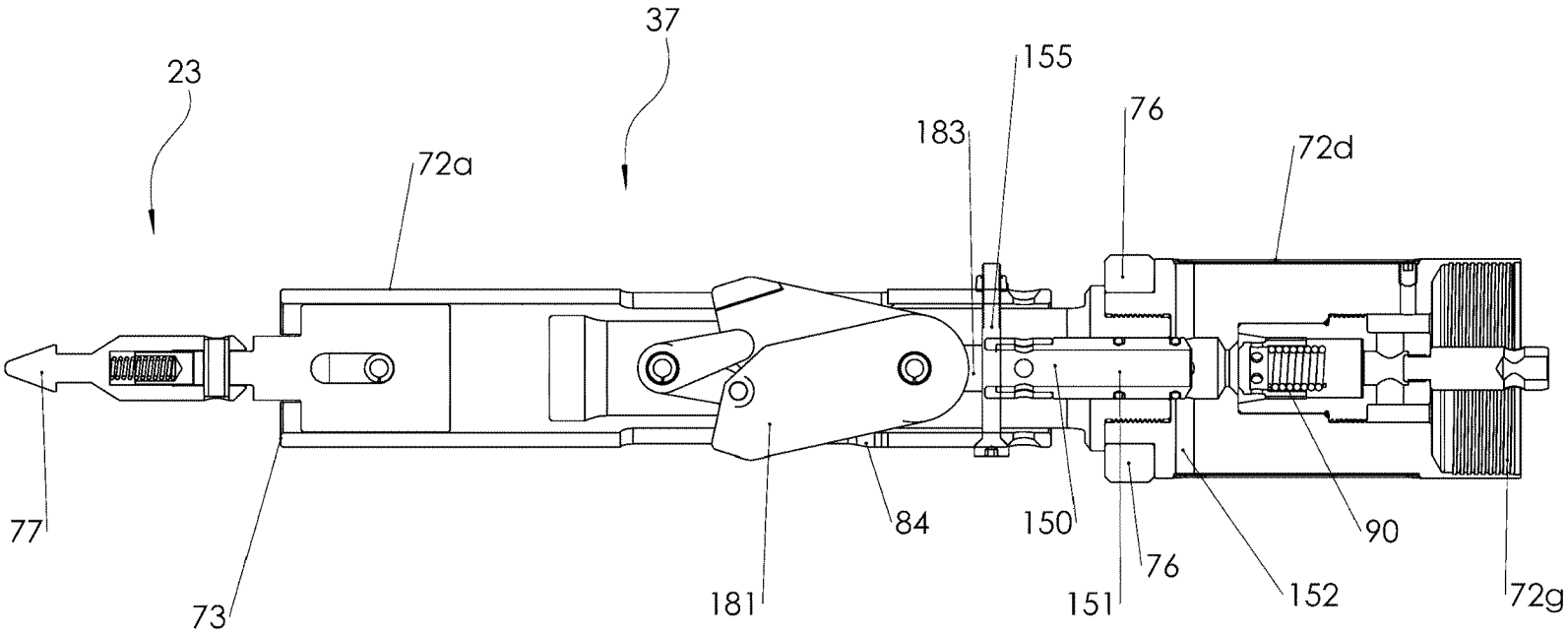
FIG. 5 is a view similar to FIG. 4, with the exception that the back end assembly is shown in another condition.

The back end assembly 37 comprises a body 71 having an upper end 73 and a lower end 75. The body 71 is of modular construction comprising a series of body sections 72 connected one to another, including upper body section 72*a* having a side wall portion 72*b*, first intermediate body section 72*c*, second intermediate body section 72*d* having a side wall portion 72*e*, and lower body section 72*f*. The lower body section 72*f* is not shown in FIGS. 4 and 5. The lower body section 72*f* is releasably connected to the second intermediate body section 72*d* by way of threaded connection 72*g*.

The upper end 73 of the back end assembly 37 is adapted for engagement with the overshot assembly (not shown), as mentioned above, so that the elongate assembly 20 can be lowered down the drill string 11 and hauled up the drill string using the wire line. In the arrangement illustrated, the back end assembly 37 includes a landing collar 76 and a spearpoint 77 configured for engagement with the overshot assembly. The overshot assembly includes a latch head retractor mechanism releasably engagable with the spearhead point 77.

The lower end 75 of the back end assembly 37 is adapted to be coupled to the upper end section 43 of the elongate body 31 by way of threaded connection 38, as previously described. In the arrangement illustrated, the lower end 75 of the back end assembly 37 is integral with the lower body section 72*f* and comprises a threaded coupling section 78 which provides the male threaded section 38*b* adapted to threadingly mate with the female threaded section 38*a* at the upper end section 43 of the elongate body 31 to provide the threaded connection 38.

The coupling section 78 includes a cavity 79 to receive corresponding end sections of the two cartridges 51, 52 accommodated the elongate body 31.

The coupling section 78 further includes two spigots 78*a* within the cavity 79 for sealing engagement in the socket formation 56 at the ends of the two cartridges 51, 52 accommodated the elongate body 31. This provides is a sealed connection between the cavity 79 and the top chambers 67.

The back end assembly 37 is adapted to selectively direct fluid pressure to the cartridges 51, 52 to exert fluid pressure onto the pistons 61 and thereby drive the pistons along their respective cylinders 53. In this embodiment, the fluid pressure is generated by pumping fluid (typically water) into the borehole above a downhole drilling assembly already within the borehole to establish a body of pressured water to operate the grouting system, with a fluid seal being established between the grout delivery system 10 and the downhole drilling assembly to retain the pressurised water above the downhole tool assembly. When the grout delivery system 10 is at the desired location and the fluid seal established, water is pumped into the drill string and pressurised.

Initially, fluid pressure is exerted on the two pistons 61 indirectly via an actuator 80 to initiate movement of the two pistons in concert. At a later stage, fluid under pressure is exerted directly on the pistons 61 to continue their movement in concert along the cylinders 53.

For this purpose, the body 71 of the back end assembly 37 includes a fluid flow path 81 extending between the exterior of the back end assembly 37 and the coupling cavity 79. Fluid flow along fluid flow path 81 is depicted by flow lines identified by reference numeral 82 in FIGS. 6 to 9. The flow path 81 is initially configured to direct fluid flow in a manner in which fluid pressure acts initially upon the actuator 80 to initiate movement of the two pistons 61 in concert (as seen in FIGS. 6 and 7) and subsequently to cause the fluid flow to bypass the actuator 80 to act directly upon the pistons 61 to continue their movement in concert along the cylinders 53 (as seen in FIGS. 8 and 9). This arrangement is advantageous as the actuator 80 serves to initiate movement of the two pistons 61 in concert mechanically, counteracting any tendency of either one or both of the pistons to "stick" in the cylinders, thereby disrupting movement of the pistons in concert. Once the pistons have commenced movement along the cylinders there is little likelihood of any "sticking" to disrupt their movement in concert, and so fluid pressure bypassing the actuator 80 can be utilised to act directly upon the pistons 61 to continue their movement in concert along the cylinders 53. As previously explained, it is important that the pistons 61 travel along their respective cylinders in concert (unison) so that appropriate relative proportions of grout component materials are made available for mixing to form grout material. If, for any reason, one piston were to advance at a rate different from the other piston, there is a likelihood that the required relative proportions of the grout component materials may be outside of acceptable limits, potentially leading to problems with the resultant grout.

The fluid flow path 81 comprise an inlet end section 83, an outlet end section 85, an intermediate section 87 and a bypass section 89.

The inlet end section 83 comprises inlet ports 84 incorporated in the side wall 72*b* of the intermediate body section 72*a* for communication with the body of pressured water within the borehole above the downhole tool assembly.

The outlet end section 85 comprises an outlet port 86 opening onto the coupling cavity 79.

The intermediate section 87 incorporates a flow control valve 90 operable to allow fluid flow along fluid flow path 81. In the arrangement shown, the flow control valve 90 is accommodated in the second intermediate body section 72*d*. The flow control valve 90 comprises a valve seat 91 and a valve member 92 movable into and out of sealing engagement with the valve seat in response to fluid pressure. The flow control valve 90 is closed against fluid flow when the valve member 92 is in sealing engagement with the valve seat 91 and is open to permit fluid flow when the valve member 92 is out of sealing engagement with the valve seat. The valve member 92 comprises a valve body which guidingly received and supported within the second intermediate body section 72*d* for reciprocatory movement into and out of sealing engagement with the valve seat 91. The valve member 92 is biased into sealing engagement with the valve seat 91 by a valve spring 94 and presents a valve face which is exposed to fluid pressure, whereby the valve member is caused to move out of sealing engagement with the valve seat 91 when the fluid pressure rises to a level which can overcome the biasing influence of the valve spring 94. The valve body incorporates bypass ports through which fluid can flow to pass around and through the valve body and proceed towards the outlet port 86 when the flow control valve 90 is open.

The bypass section 89 functions to allow fluid pressure to act initially upon the actuator 80 to initiate movement of the two pistons 61 in concert and subsequently bypass the actuator 80 to act directly upon the pistons 61 to continue their movement in concert along the cylinders 53.

In the arrangement shown, the flow control valve 90 is accommodated within a valve housing 101 configured as an insert removably located within second intermediate body section 72*d* of the back end assembly 37. The insert comprises a base portion 105 which is threadably engaged with the second intermediate body section 72*d* of the back end assembly 37 and a shank portion 107 projecting from the base portion into the coupling cavity 79.

The base portion 105 accommodates the flow control valve 90 and incorporates a flow passage 109 from the flow control valve to outlet ports 111 which open onto a surrounding annular space 113 communicating with the coupling cavity 79. The flow passage 109 and the outlet ports 111 define part of the fluid flow path 81. With this arrangement, fluid flow from the flow control valve 90 can enter the coupling cavity 79 via the surrounding annular space 113, as best seen in FIG. 6.

The shank portion 107 accommodates a further flow passage 115 extending between inlet ports 117 opening onto the surrounding portion of the coupling cavity 79, and an outlet port 119 at the free end of the shank portion 107 opening onto the adjacent portion of the coupling cavity 79. The further flow passage 115, together with the inlet ports 117 and the outlet port 119, define part of the fluid flow path 81. With this arrangement, fluid within the coupling cavity can enter the further flow passage 115 through inlet ports 117 and discharge from the further flow passage 115 through outlet port 119 in certain circumstances, dependent upon the position of the actuator 80 as will be explained later.

The actuator 80 is configured as a piston arrangement 120 comprising a piston head 121 and two piston rods 123 extending from the piston head to one side thereof. The two piston rods 123 correspond to the two pistons 61 within the cartridges 51, 52.

The lower end 75 of the back end assembly 37 defines a cylinder section 127 bounded by a cylinder wall 129 within the coupling cavity 79. The piston head 121 is accommodated within the cylinder section 127 in slidable and sealing engagement with the cylinder wall 129. With this arrangement, the piston head 121 divides the cylinder section 127 into first and second chambers 131, 132 which vary in volume as the piston head moves within the cylinder section.

Further, the piston head 121 includes a central opening 135 through which the shank portion 107 extends, with the piston head being in slidable and sealing engagement with the shank portion. With this arrangement, the piston head 121 functions to isolate the inlet ports 117 and the outlet ports 111 within the fluid flow path 81 from each other at stages when the piston head 121 is located between those ports; that is, at times when the inlet ports 117 are in communication with the second chamber 132 and isolated from the first chamber 131, as best seen in FIGS. 6 and 7. Further, the piston head 121 can advance along the cylinder section 127 to an extent that the inlet ports 117 are no longer in communication with the second chamber 132 and isolated from the first chamber 131, but rather are in communication with the first chamber 131, as best seen in FIGS. 8 and 9. At such a stage, the inlet ports 117 and the outlet ports 111 within the fluid flow path 81 are no longer isolated from each other, thereby permitting fluid flow through inlet ports 117, along the further flow passage 115 to the outlet port 119 at the free end of the shank portion 107 and into the second chamber 132 to act directly upon the pistons 61 within the two cartridges 51, 52 accommodated the elongate body 31.

The two piston rods 123 extending from the piston head 121 are configured for detachable engagement with the two pistons 61. Specifically, each piston 61 comprises a piston body 141 having a side wall 143 in sliding and sealing engagement with the respective cylinder 53, and opposed end faces 145, 146. End face 145 confronting the actuator 80 incorporates a recess 147 into which the free end of the respective piston rod 123 can be removably received, as shown in FIGS. 6, 7 and 8.

With this arrangement, the actuator 80 is operable under fluid pressure to initiate movement of the two pistons 61 in concert along the cylinders 53 in response to fluid pressure at the start of the grouting operation (as seen in FIGS. 6 and 7). Once the pistons 61 have commenced movement they are then subjected to direct fluid pressure to continue their movement in concert along the cylinders 53, initially separating from the piston rods 123 and then independently continuing their movement along the cylinders 53 (as seen in FIGS. 8 and 9).

Specifically, fluid under pressure is admitted into the first chamber 131 to act upon the actuator 80, causing the piston head 121 to advance along the cylinder section 127, resulting in volume expansion of the first chamber 131 and volume contraction of the second chamber 132.

Initially, the piston head 121 is located between the outlet ports 111 and inlet ports 117 and accordingly the piston head functions to isolate the inlet ports 117 and the outlet ports 111 from each other; that is, the inlet ports 117 are only in communication with the second chamber 132 and are isolated from the first chamber 131, as best seen in FIGS. 6 and 7. At this stage, the actuator 80 mechanically pushes the pistons 61 along the cylinders 53 by way of engagement between the two piston rods 123 of the actuator and the pistons 61.

The piston head 121 can advance along the cylinder section 127 so as to pass beyond the inlet ports 117, thereby exposing the inlet ports to the first chamber 131 and isolating them from the second chamber 132. At this stage, the inlet ports 117 are no longer in communication with the second chamber 132 and isolated from the first chamber 131, but rather are in communication with the first chamber 131, as best seen in FIGS. 8 and 9. Accordingly, the inlet ports 117 and the outlet ports 111 within the fluid flow path 81 are no longer isolated from each other, thereby permitting fluid flow through inlet ports 117, along the further flow passage 115 to the outlet port 119 at the free end of the shank portion 107 and into the second chamber 132 to act directly upon the pistons 61 within the two cartridges 51, 52 accommodated the elongate body 31. The fluid pressure acting directly upon the pistons 61 acts to continue movement of the pistons 61 in concert along the cylinders 53. At this stage movement of the actuator 80 ceases, and the piston rods 123 now moving under the influence of direct fluid pressure separate from the two piston rods 123 of the actuator 80 and continue their movement along the cylinders 53 independently of the actuator (as seen in FIGS. 8 and 9).

With this arrangement, the flow control valve 90 is configure to allow fluid flow along the fluid flow path 81 into the coupling cavity 79, and thereby admission of fluid under pressure into the two top chambers 67 which are in communication with the coupling cavity 79, in response to a fluid pressure supply exceeding a prescribed level. In this embodiment, the flow control valve 90 is responsive to a fluid supply pressure exceeding 215 psi; that is, the valve is caused to open to allow fluid flow along the fluid flow path 81 when the fluid pressure on the intake side of the valve exceeds 215 psi. It will, of course, be understood that the prescribed pressure can be selected at any appropriate level and need not be limited to 215 psi.

In this embodiment, the source which is used to supply fluid pressure to actuate the grout delivery system 10 comprises water which is pumped into the drill string. In other words, the actuating pressure for the grout delivery system 10 is, in this embodiment, delivered by the fluid circulating pump of the drill rig. It should, however, be understood that other arrangements may be implemented to supply fluid pressure to actuate the grout delivery system 10, as would be understood by a person skilled in the art.

With this arrangement, water under pressure flows into the back end assembly 37 and into the entry side of the flow path 81. If the water pressure exceeds the prescribed level (which in this embodiment is 215 psi), the pressure-responsive control valve 90 is caused to open and thereby allow water flow along the fluid path 81 and into the two top chambers 67. The resultant water pressure exerted onto the pistons 61 moves the pistons along their respective cylinders 53, causing volume contraction of the two bottom chambers 65.

Retrieval of the grout delivery system 10 may necessitate relief of the hydrostatic pressure differential across the fluid seal established between landing collar 76 on the back end assembly 37 on a landing ring on the downhole drilling assembly so that the grout delivery system 10 can be lifted relatively easily from the downhole drilling assembly. Even after termination of pressurisation of the body of water in the drill string above the downhole tool assembly, a remnant hydrostatic pressure may exist across the fluid seal. A selectively operable pressure relief system 150 is provided for this purpose.

The pressure relief system 150 is incorporated in the back end assembly 37. As previously described, the body 71 of the back end assembly 37 is of modular construction comprising a series of body sections 72 connected one to another, including upper body section 72*a* having a side wall portion 72*b*, first intermediate body section 72*c*, second intermediate body section 72*d* having a side wall portion 72*e*, and lower body section 72*f*.

Figure 11:
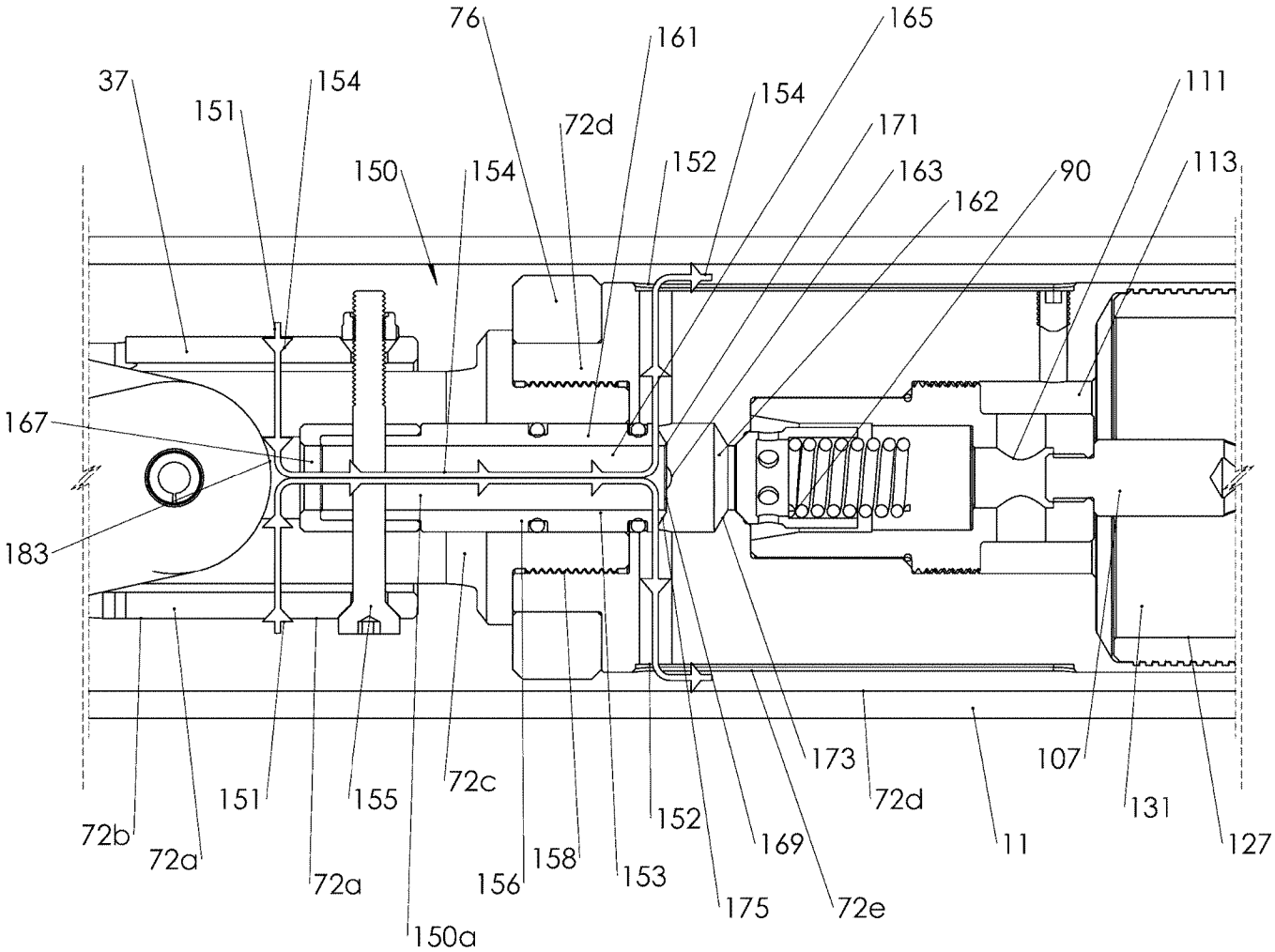
FIG. 11 is a schematic view of a portion of the grout delivery system, illustrating in particular a bypass arrangement for relieving a hydrostatic pressure differential to facilitate retrieval of the grout delivery system from a downhole location.

Referring in particular to FIG. 11, the pressure relief system 150 comprises a pressure relief fluid flow path 150*a* extending between one or more inlet ports 151 on the side wall portion 72*b* of upper body section 72*a* and a one or more outlet ports 152 on the side wall portion 72*e* of second intermediate body section 72*d*. In the arrangement shown, there are four inlet ports 151 in circumferentially spaced relation, and also four outlet ports 152 in circumferentially spaced relation.

The pressure relief system 150 further comprises a valve 153 for selectively opening and closing the pressure relief fluid flow path 150*a* with respect to fluid flow from the inlet ports 151 to the outlet ports 152.

The inlet ports 151 and the outlet ports 152 open onto the exterior of the back end assembly 37 and are disposed on opposed sides of the landing collar 76, as best seen in FIG. 11. With this arrangement, the fluid flow path 150*a*, when open, can accommodate fluid flow across the fluid seal established between the landing collar 76 on the back end assembly 37 and the counterpart landing ring on the downhole drilling assembly to relieve any hydrostatic pressure differential. Water flow along the fluid flow path 150*a* is depicted by flow lines identified by reference numeral 154 in FIG. 11.

In this embodiment, the valve 153 for selectively opening and closing the pressure relief fluid flow path 150*a* is operable remotely by an operator above ground, as will be explained.

The upper body section 72*a* of the body 71 of the back end assembly 37 is connected to the first intermediate body section 72*c* by way of a nut and bolt assembly 155.

The first intermediate body section 72*c* has a spigot portion 156 which is received in a mating portion 157 of the upper body section 72*a* and retained by the nut and bolt assembly 155.

The first intermediate body section 72*c* is connected to the second intermediate body section 72*d* by threaded connection 158. The landing collar 76 is supported on the second intermediate body section 72*d*.

The valve 153 further comprises a valve stem 161 and a valve seat 162. The valve stem 161 is movable between open and closed conditions with respect to the valve seat 162. A flow gallery 163 is provided adjacent the valve seat 162 and the valve stem 161 is movable into and out of the flow gallery.

The valve stem 161 incorporates an axial flow passageway 165 which constitutes part of the pressure relief fluid flow path 150*a* between the inlet ports 151 to the outlet ports 152. The axial flow passageway 165 has an inlet end section 167 for communication with the inlet ports 151 and an outlet end section 169 for communication with the outlet ports 152. The axial flow passageway 165 opens onto the free end of the valve stem 161 at valve outlet opening 171 for communication with the flow gallery 163 when the valve stem 161 is in the open condition, as will be explained.

The outlet ports 152 open onto the flow gallery 163 adjacent the valve seat 162 at their inner ends 152*a*, as shown in FIG. 11.

The valve seat 162 includes a valve seat face 173 and the free end of the valve stem 161 includes a valve sealing face 175 which surrounds the valve outlet opening 171 and which is configured for sealing engagement with the valve seat face 173.

The valve stem 161 is movable axially between the closed condition in which the valve sealing face 175 is in sealing engagement with the valve seat face 173 to thereby close the valve outlet opening 171 and the open condition in which the valve sealing face 175 is clear of the valve seat face 173 so allowing fluid to flow along the axial flow passageway 165 into the flow gallery 163 adjacent the valve seat 162 and then to the outlet ports 152 which open onto the flow gallery 163. In the closed condition, the portion of the valve stem 161 within the flow gallery 163 also blocks communication between the flow gallery 163 and the outlet ports 152. The valve stem 161 normally occupies the closed condition, thereby blocking the pressure relief fluid flow path 150*a*.

The valve stem 161 is operatively coupled to a latch mechanism 181 which is operable remotely by an operator above ground. Specifically, the latch mechanism 181 normally occupies a first condition and is movable from that first condition to a second condition upon application of an uplifting force to the wire line attached to the overshot assembly coupled to the back end assembly 37. The valve stem 161 is connected to the latch mechanism 181 whereby movement of the latter from the first condition to the second condition causes axial movement of the valve stem 161 from the normally closed condition to the open condition, thereby opening the pressure relief fluid flow path 150*a* to allow fluid flow passed the fluid seal to provide hydrostatic pressure relief. In the arrangement shown, the valve stem 161 is connected to the latch mechanism 181 mechanically by link 183 which translates motion of the latch mechanism 181 to axial movement of the valve stem 161.

The bottom position of the loaded grout delivery system 10 within the borehole is determined by location of the landing collar 76 on the back end assembly 37 on a landing ring on a downhole drilling assembly. This location establishes a fluid seal whereby fluid (typically water) can be pumped into the borehole above the downhole tool assembly to generate the fluid pressure as previously described in order to operate the grouting system. When the loaded grout delivery system 10 is at the desired location and the fluid seal established, water is pumped into the drill string and pressurised. The delivery head assembly 39 comprises a delivery nozzle 191.

The delivery nozzle 191 comprises a nozzle body 193 having an inner end 195 and an outer end 197.

The nozzle body 193 comprises a threaded coupling at the inner end 195 configured as threaded female coupling section 196 adapted to threadingly mate with the male coupling section 55 at the lower end section 48 of the elongate body 31.

The nozzle body 193 further comprises a mixing zone 203 and two delivery passages 205 having inlet ends 207 for communication with the cartridges 51, 52 to receive grout component material therefrom and outlet ends 209 communicating with the mixing zone 203 for delivery of the grout component materials into the mixing zone. The mixing zone 203 is of known kind and comprises a baffle arrangement 211 which provided a tortuous path along which the grout component materials to effect mixing thereof to form the grout.

The nozzle body 193 incorporates an outlet opening 213 through which the grout formed by mixing of the grout component materials in the mixing zone 203 is discharged into the borehole.

With this arrangement, the two grout component materials emanating from the reservoirs 41, 42 are brought together for mixing in the mixing zone 203 to form the grout for delivery through the outlet opening 213 as a highly viscous fluid mixture. In FIG. 10, the grout being delivered through outlet opening 213 is depicted in outline and identified by reference numeral 215.

The nozzle body 193 incorporates two spigots 217 for sealing engagement in the socket formation 58 at the ends of the two cartridges 51, 52 accommodated the elongate body 31. This provides is a sealed connection between the reservoirs 41, 42 and the delivery nozzle 191 for passage of grout component materials.

In the arrangement shown, the delivery nozzle 191 comprises several parts 220 which are assembled together to provide the nozzle body 193, as best seen in FIG. 10.

In operation, the reservoirs 41, 42 are charged with the grout component materials by loading through the lower end section 48 of the elongate body 31. The delivery head assembly 39 is then installed in position on the elongate body 31.

When a section of the borehole being drilled required grouting, the drilling string is partially withdrawn to expose the area to be grouted, and the loaded grout delivery system 10 is lowered down the drill string using the overshot assembly (not shown) attached to the wire line. During the descent of the loaded grout delivery system 10, the two spring-loaded disc valves 68 function to prevent the ingress of any water within the borehole into the reservoirs 41, 42 as previously explained. The bottom position of the loaded grout delivery system 10 within the borehole is determined by location of the landing collar 76 on the back end assembly 37 on a landing ring on a downhole drilling assembly. This location establishes a fluid seal whereby fluid (water) can be pumped into the borehole above the downhole tool assembly to generate the fluid pressure as previously described in order to operate the grouting system. When the loaded grout delivery system 10 is at the desired location and the fluid seal established, water is pumped into the drill string and pressurised. The pressurised water flows into the back end assembly 37 and into the entry side of the flow path 81. Once the water pressure exceeds the prescribed level (which in this embodiment is 215 psi), the pressure-responsive flow control valve 90 is caused to open and thereby allow water to flow along the fluid path 81 and into the two top chambers 67. The resultant fluid pressure causes the pistons 61 to move along their respective cylinders 62, as previously described, thereby causing volume contraction of the two bottom chambers 65. This expels grout component material from the reservoirs 41, 42 and causes the expelled material to flow along the respective flow passages 107 in the valve assembly 101. The respective flows of expelled material exert pressure on the two spring-loaded disc valves 68 which open when the pressure exceeds the prescribed level (which is 10 psi in this embodiment). The respective flows of expelled material enter the nozzle body 193 and pass along the mixing zone 203, undergoing mixing to react chemically to form the grout which is discharged as a viscous fluid mixture through the outlet opening 209 and delivered into the borehole. At the completion of the grout delivery process, the delivery of pressurized water into the borehole is terminated and the grout delivery system 10 retrieved by raising it to the ground surface using the using the overshot assembly (not shown) attached to the wire line. Retrieval of the grout delivery system 10 may necessitate relief of the hydrostatic pressure differential across the fluid seal established between landing collar 76 on the back end assembly 37 on a landing ring on the downhole drilling assembly so that the grout delivery system 10 can be lifted relatively easily from the downhole drilling assembly. The pressure relief system serves this purpose. Specifically, an operator at ground level applies an uplifting force to the wire line attached to the overshot assembly coupled to the the back end assembly 37. This causes the latch the latch mechanism 181 to move from the first condition, which it normally occupies, to the second condition which in turn causes axial movement of the valve stem 161 from the normally closed condition to the open condition, thereby opening the pressure relief fluid flow path 150*a* to allow fluid flow passed the fluid seal to provide hydrostatic pressure relief. The hydrostatic pressure relief equalises fluid pressure across the seal, enabling the gout delivery system 10 to be lifted from downhole drilling assembly and then hauled up the borehole to ground surface. At ground surface, the cartridges 51, 52 can be replaced as necessary when replenishment grout component materials are required.

The valve stem 161 is connected to the latch mechanism 181 whereby movement of the latter from the first condition to the second condition causes axial movement of the valve stem 161 from the normally closed condition to the open condition, thereby the pressure relief fluid flow path 150*a* to allow fluid flow passed the fluid seal to provide hydrostatic pressure relief. In the arrangement shown, the valve stem 161 is connected to the latch mechanism 181 mechanically by link 183 which translates motion of the latch mechanism 181 to axial movement of the valve stem 161.

From the foregoing, it is evident that the present embodiments provide a system and method for delivering grout component materials to a location within a bore hole, at which the grout component materials are mixed together to form the grout and deliver the grout as a flowable substance which can set after delivery. It is a particular feature of the embodiment that the grout components are mixed together at the location of delivery within the borehole and then delivered into the borehole.

In the embodiments described, the two reservoirs 41, 42 were described as being used to contain charges of two grout component materials which react chemically to form the grout. The two reservoirs 41, 42 may, of course, contain other types of grout materials.

Further, the two reservoirs may in fact be charged with the same type of material. With this arrangement, the two reservoirs would simply provide increased holding capacity for that material.

Further, the delivery system may comprise more than two reservoirs to facilitate mixing of more than two components to form the flowable substance to be delivered.

It should be appreciated that the scope of the invention is not limited to the scope of the embodiment described.

While the embodiment has have been described with particular reference to delivery of grout into a borehole, it should be understood that the invention need not necessarily be limited to that application. The invention may be applicable to tool assembly for delivery of other flowable substances into boreholes or to delivery of flowable substances to other remote locations. By way of example, the invention may find application in the delivery of flowable substances into a distant section of pipeline which is not otherwise readily accessible for the purpose of repairing or blocking that section of pipeline.

Modifications and improvements may be made without departing from the scope of the invention. In particular, while the present invention has been described in terms of a preferred embodiment in order to facilitate better understanding of the invention, it should be appreciated that various modifications can be made without departing from the principles of the invention. Therefore, the invention should be understood to include all such modifications within its scope.

Reference to positional descriptions, such as "lower", "upper", "top" and "bottom" are to be taken in context of the embodiment depicted in the drawings, and are not to be taken as limiting the invention to the literal interpretation of the term but rather as would be understood by the skilled addressee.

Additionally, where the terms "system", "device", "apparatus" and "tool" are used in the context of the invention, they are to be understood as including reference to any group of functionally related or interacting, interrelated, interdependent or associated components or elements that may be located in proximity to, separate from, integrated with, or discrete from, each other.

Throughout this specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. A delivery system for delivery of a flowable substance as a mixture comprising first and second components at a location to which the delivery system is conveyed, the delivery system comprising a first reservoir for receiving a charge of the first component, a second reservoir for receiving a charge of the second component, each reservoir being defined within a respective body defining a cylinder having a first end and a second end, a piston receivable in the cylinder for sliding movement therealong, each piston being operable for movement along the respective cylinder in response to fluid pressure, and an actuator, whereby fluid pressure can act initially upon the actuator to initiate movement of the pistons in concert and subsequently bypass the actuator to act directly upon the pistons to continue movement of the pistons in concert along the cylinders.

2. The delivery system according to claim 1 wherein the bodies defining the first and second reservoirs are each configured as a cartridge.

3. The delivery system according to claim 2 further comprising a housing in which the cartridges are removably receivable.

4. The delivery system according to claim 1 further comprising a flow control valve for controlling the supply of fluid pressure to cause movement of the pistons along the cylinders, the flow control valve being configured to allow admission of fluid under pressure in response to a fluid pressure supply exceeding a prescribed level.

5. The delivery system according to claim 1, further comprising a flow path configured to initially direct a fluid flow in a manner in which fluid pressure acts initially upon the actuator to initiate movement of the two pistons in concert and to subsequently cause the fluid flow to bypass the actuator and act directly upon the pistons to continue movement of the pistons in concert along the cylinders.

6. The delivery system according to claim 1, wherein the actuator is configured to act mechanically upon the pistons to cause the pistons to move in concert.

7. The delivery system according to claim 6, wherein the actuator is configured as a piston arrangement comprising a piston head and a plurality of piston rods one corresponding to each reservoir, the piston rods extending from the piston head to one side thereof and being configured for detachable engagement with the pistons.

8. The delivery system according to claim 7, further comprising a flow path configured to initially direct a fluid flow in a manner in which fluid pressure acts initially upon the actuator to initiate movement of the two pistons in concert and to subsequently cause the fluid flow to bypass the actuator and act directly upon the pistons to continue movement of the pistons in concert along the cylinders, wherein the piston head is accommodated within a cylinder section bounded by a cylinder wall for slidable and sealing engagement with the cylinder wall, the piston head dividing the cylinder section into first and second chambers which vary in volume as the piston head moves within the cylinder section, and wherein the piston head includes an opening through which a shank portion extends, with the piston head being in slidable and sealing engagement with the shank portion, the shank portion accommodating a flow passage extending between one or more inlet ports opening onto the cylinder section and one or more outlet ports, whereby the flow passage within the shank portion, together with the inlet port(s) and the outlet port(s), define part of the fluid flow path.

9. The delivery system according to claim 1, further comprising a bypass for fluid to flow past the actuator once the actuator has acted upon the pistons to cause movement thereof in concert, whereby the fluid bypassing the actuator thereafter acts upon the pistons to continue movement of the pistons in concert along the cylinders.

10. The delivery system according to claim 1, further comprising a closure receivable in each cylinder for location at or adjacent the second end, whereby the reservoir is defined within the cylinder between the piston and the closure, the closure being selectively openable in response to pressure exerted by the respective component of the flowable substance in the reservoir in response to movement of the piston along the cylinder causing volume contraction of the reservoir.

* * * * *